US007770236B2

(12) United States Patent
Gulisano

(10) Patent No.: US 7,770,236 B2
(45) Date of Patent: Aug. 10, 2010

(54) DETACHABLE APPAREL COLLAR

(76) Inventor: Lori Gulisano, 20 Monticello Ct., Lafayette, CA (US) 94549

( * ) Notice: Subject to any disclaimer, the term of this patent is extended or adjusted under 35 U.S.C. 154(b) by 71 days.

(21) Appl. No.: 12/018,720

(22) Filed: Jan. 23, 2008

(65) Prior Publication Data

US 2009/0183293 A1 Jul. 23, 2009

(51) Int. Cl.
*A41D 27/00* (2006.01)

(52) U.S. Cl. ..... 2/98; 2/116; 2/127; 2/129; 2/130; 2/139; 2/60

(58) Field of Classification Search ..... 2/60, 2/98, 100, 116, 127, 128, 129, 130, 131, 2/132, 133, 134, 135, 139, 142; 223/83
See application file for complete search history.

(56) References Cited

U.S. PATENT DOCUMENTS 1,248,332 A * 11/1917 Isenhour ..... 2/98
2,089,748 A * 8/1937 Herscovitch ..... 2/132
2,500,985 A * 3/1950 Goetz ..... 2/127
2,997,718 A * 8/1961 Jacobs ..... 2/139
3,060,447 A * 10/1962 Dethier ..... 2/132
3,333,280 A * 8/1967 Hynek et al. ..... 2/143
2007/0033702 A1 2/2007 Hsu

FOREIGN PATENT DOCUMENTS

JP 2001020101 A 1/2001

OTHER PUBLICATIONS

ISA/KR, PCT International Search Report and Written Opinion, Application No. PCT/US2009/031617, dated Sep. 23, 2009, 8 pages.

* cited by examiner

*Primary Examiner*—Gary L Welch
*Assistant Examiner*—Alissa J Tompkins
(74) *Attorney, Agent, or Firm*—Kang Lim

(57) ABSTRACT

A detachable collar is provided. The collar is useful in association with a garment including a permanent collar. The detachable collar includes a collar body which includes a front side, a back side, and an interfacing layer. The collar body may be substantially trapezoidal, and variable in length. The collar body also includes a left pocket and a right pocket, which engage the permanent collar. The pockets are located on the back side of the collar body. The detachable collar also includes at least one fastener coupled to the collar body. The fasteners may be located at the base and on the back side of the collar body. The fasteners may be configured to engage the permanent collar, or a collarless garment along the neckline. The fasteners may include a pin and a cap. The pin pierces the permanent collar, and the cap in turn engages the pin.

16 Claims, 7 Drawing Sheets

DETACHABLE APPAREL COLLAR

BACKGROUND OF THE INVENTION

This invention relates generally to apparel. More particularly, this invention relates to detachable style collars for addition to jackets, collars or other apparel tops, thereby improving the versatility of a wardrobe. Additionally, such a collar may provide additional comfort for the wearer, as well as additional warmth.

Modern shirt collars evolved from the whisk collar and falling band, which in turn evolved from the Elizabethan ruff. The Elizabethan ruff, in turn, was born from the ruffle created by the drawstring at the neck of the medieval chemise.

Collars have evolved into many distinct styles, including standing, turnover and flat collar categories. "Standing" or "stand-up" collars fit high up around the neck and do not lie on the shoulders. Likewise, "turnover" collars also stand high around the neck, but then folded or rolled over. Lastly, "flat" or "falling" collars lie flat on the shoulders of the wearer.

The shape of collars may also be controlled by the shape of the neckline to which they are attached. Most collars are fitted to a jewel neck, a neckline sitting at the base of the neck and extending all around the neck. In instances where the garment opens down the front, the top edges of the garment may be folded back to form lapels and a V-shaped opening, and the cut of the collar may be adjusted accordingly.

Collars may also be "stiffened", traditionally with starch. Modern wash-and-wear shirt collars may be stiffened with interfacing. Shirt collars which are not stiffened are described as "soft".

Separate collars have existed along side attached collars since the mid-16th century, usually to allow starching and other fine finishing. However, traditional separate collars typically require special fasteners to couple to a particular piece of clothing. As such, current separate collars are limited to which garments they may attach to. Additionally, for the modern active individual, previous separate collars fail to fasten to garments securely enough to be practical for most occasions. As such, these separate collars are typically substantially limited to formalwear garments.

It would be advantageous to have a separate collar that may seamlessly attach and detach from a wide range of garments, including garments that already have an attached collar. Moreover, it would be advantageous that such separate collar be capable of coupling to the garment securely even when the wearer engages in an active lifestyle.

It is therefore apparent that an urgent need exists for an improved separate and detachable collar. The envisioned detachable collar may couple to a wide range of garments, including garments that typically are unable to include a separate collar. Additionally, the envisioned detachable collar may securely couple to the garment even when the wearer engages in an active lifestyle.

SUMMARY OF THE INVENTION

To achieve the foregoing and in accordance with the present invention, an improved detachable collar is provided. Such an improved detachable collar may be of particular use for enhanced comfort style and warmth, as well as expanding the use of wardrobes.

The detachable collar is useful in association with a garment, where the garment includes a permanent collar. The detachable collar includes a collar body. The collar body includes a front side and a back side. The collar body may also include an interfacing layer. The collar body may also be substantially trapezoidal, and variable in length.

The collar body also includes a left pocket and a right pocket. The left pocket and the right pocket may engage the permanent collar. The left pocket and the right pocket are located on the back side of the collar body.

The detachable collar also includes at least one fastener. The fasteners may be coupled to the collar body. The fasteners may be located at the base of the collar body, and on the back side of the collar body. The fasteners may be configured to engage the permanent collar, or a collarless garment along the neckline. The fasteners may include a pin and a cap. The pin pierces the permanent collar, and the cap in turn engages the pin.

Note that the various features of the present invention described above may be practiced alone or in combination. These and other features of the present invention will be described in more detail below in the detailed description of the invention and in conjunction with the following figures.

BRIEF DESCRIPTION OF THE DRAWINGS

In order that the present invention may be more clearly ascertained, one or more embodiments will now be described, by way of example, with reference to the accompanying drawings, in which.

DETAILED DESCRIPTION OF THE INVENTION

The present invention will now be described in detail with reference to several embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention. The features and advantages of the present invention may be better understood with reference to the drawings and discussions that follow.

Figure 1A:
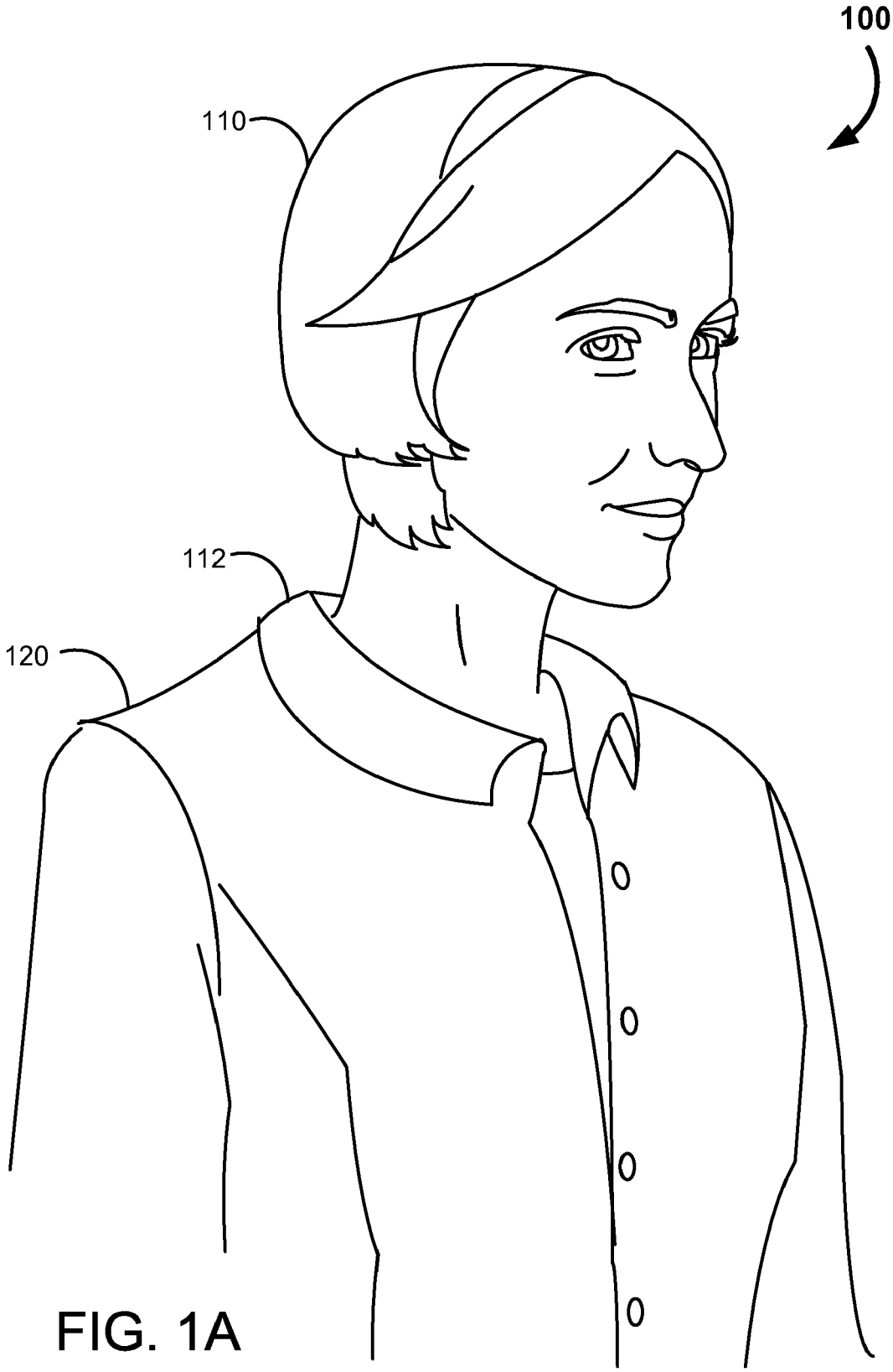
FIG. 1A shows a perspective illustration of a garment worn by a wearer in accordance with an embodiment of the present invention.

To facilitate discussion, FIG. 1A shows a perspective illustration of a Garment 120 worn by a Wearer 110, shown generally at 100. In this exemplary illustration, the Garment 120 includes a Permanent Collar 112.

Additionally, the Wearer 110 illustrated is a woman. The present invention is designed to be useful for any gender of Wearer 110. Likewise the Wearer 110 may be any age. The styling and sizing of various embodiments of the disclosed invention may be different to achieve this aim.

Also, in the exemplary illustration the Garment 120 is shown as a jacket. It should be noted, however, that an array of garments are suitable for the Garment 120 in conjunction with the disclosed invention. Typical articles for the Garment 120 include jackets, sweaters, shirts, vests, dresses, blazers or any other garment that extends to the neck of the Wearer 110.

Figure 1B:
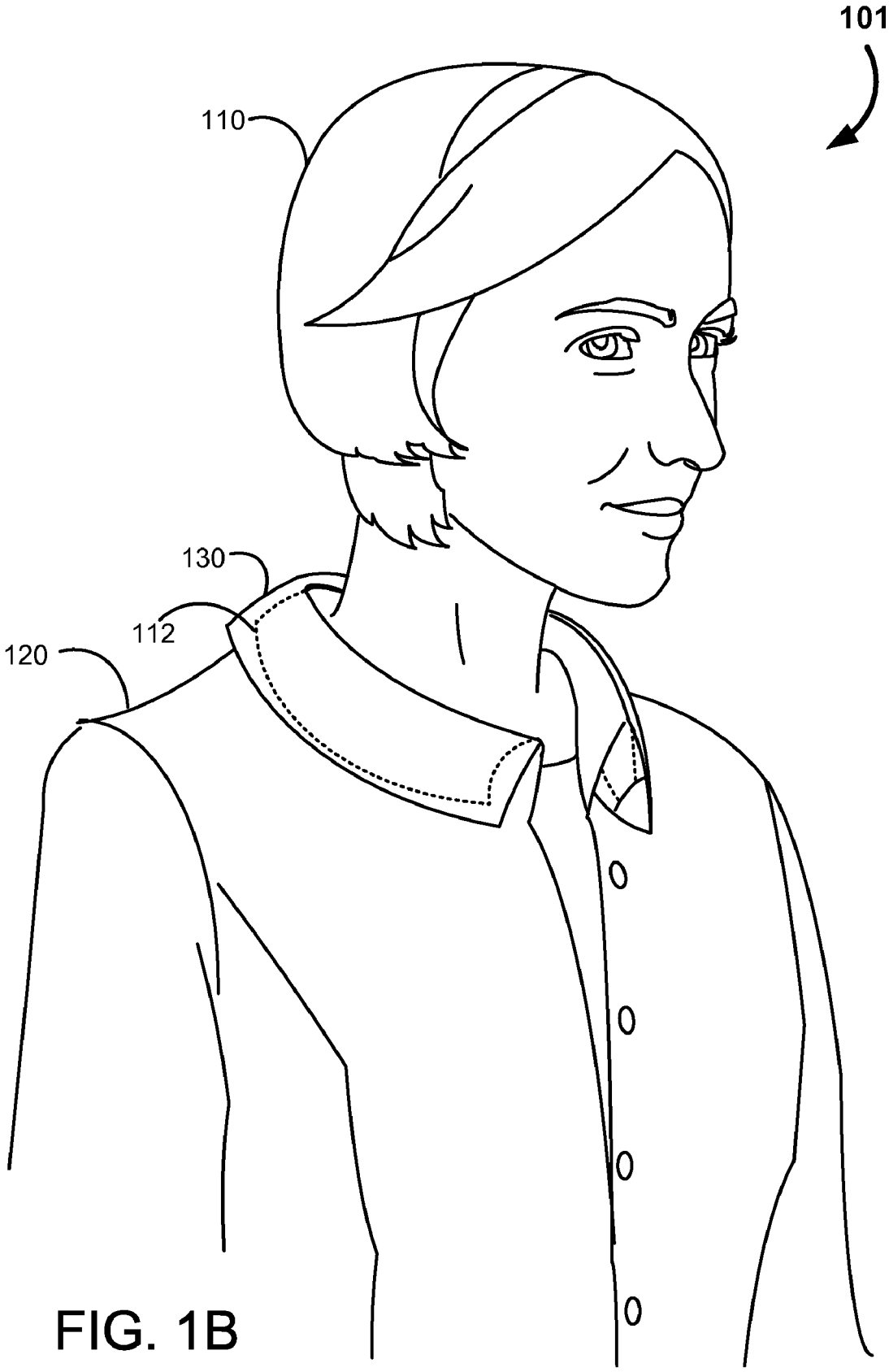
FIG. 1B shows a perspective illustration of a detachable collar coupled to a garment worn by a wearer in a flat orientation in accordance with an embodiment of the present invention.

FIG. 1B shows a perspective illustration of a detachable collar coupled, in a flat orientation, to a Garment 120 worn by a Wearer 110, shown generally at 101. In this exemplary illustration, the Detachable Collar 130 is shown as a "flat" or "falling" collar. It should be understood, however, that dependent upon Detachable Collar 130 configuration, and method of coupling the Detachable Collar 130 to the Garment 120 may result in either a "standing" collar or a "falling" collar, as previously discussed.

The Permanent Collar 112 may be seen as fitting beneath, and coupling to the Detachable Collar 130. Specific methods of coupling the Detachable Collar 130 to the Permanent Collar 112 will be further discussed below in FIG. 4.

Additionally, as previously stated, the Wearer 110 illustrated is a woman. The Detachable Collar 130 is designed to be useful for any gender of Wearer 110. Likewise the Wearer 110 may be any age. The styling and sizing of various embodiments of the Detachable Collar 130 may be different to achieve this aim. Also, in some alternate embodiments, the sizing of the Detachable Collar 130 may be adjustable as to enable its usage with a wide range of Wearers 110.

Figure 1C:
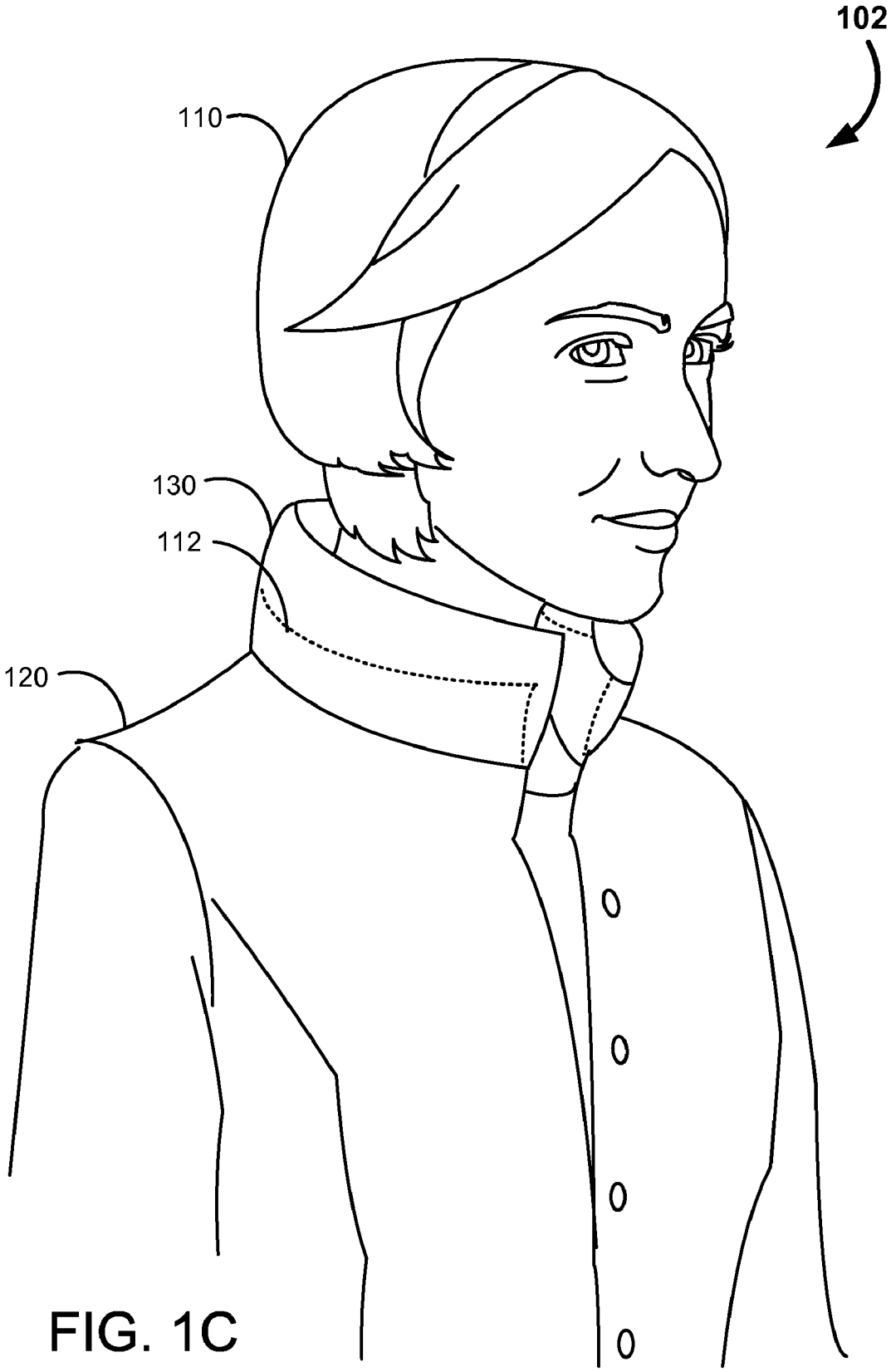
FIG. 1C shows a perspective illustration of a detachable collar coupled to a garment worn by a wearer in a standing orientation in accordance with an embodiment of the present invention.

FIG. 1C shows a perspective illustration of a Detachable Collar 130 coupled, in a standing orientation, to a Garment 120 worn by a Wearer 110, shown generally at 102. In this exemplary illustration, the Detachable Collar 130 is shown as a "standing" collar. As previously noted, dependent upon Detachable Collar 130 configuration, and method of coupling the Detachable Collar 130 to the Garment 120 may result in either a "standing" collar or a "falling" collar, as previously discussed.

The Permanent Collar 112 may be seen as fitting behind, and coupling to the Detachable Collar 130. Specific methods of coupling the Detachable Collar 130 to the Permanent Collar 112 will be further discussed below in FIG. 4.

Figure 2:
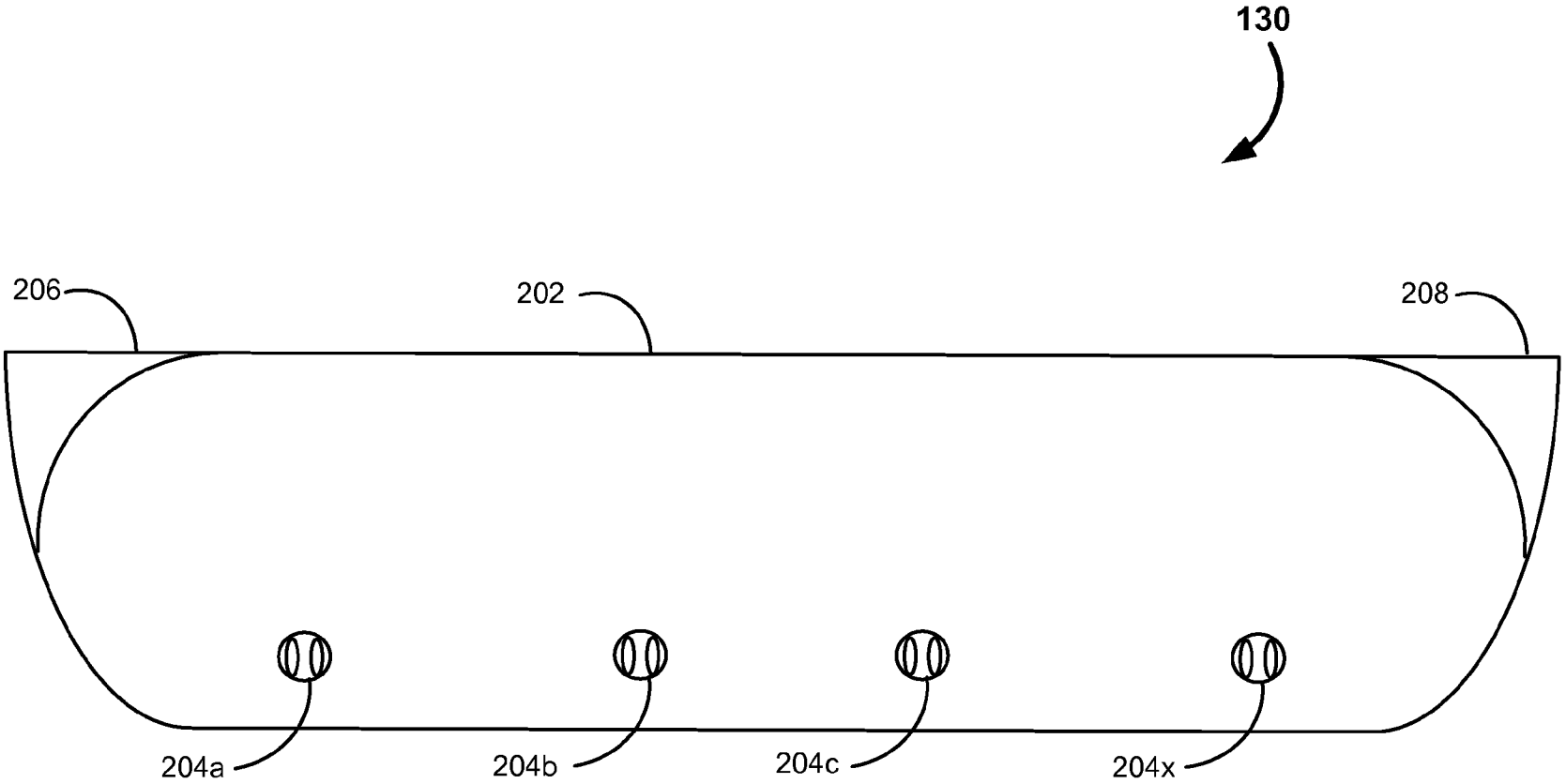
FIG. 2 shows a detailed illustration of a detachable collar in accordance with an embodiment of the present invention.

FIG. 2 shows a detailed illustration of the Detachable Collar 130. The bulk of the Detachable Collar 130 includes the Collar Body 202. The Collar Body 202 in this exemplary illustration is near trapezoidal shaped; however, a range of shapes may be utilized for the Detachable Collar 130. Additionally, length and width of the Collar Body 202 may vary as is desired for apparel type, aesthetics and Wearer 110 size. In particular, the length of the Collar Body 202 may be increased for a Wearer 110 who has a thick neck, and reduced in length for a petite individual. In some embodiments, this length may be adjustable through pleating, buckles, loop and hook material, or any other suitable method.

The Detachable Collar 130 may additionally include more than one Fastener 204*a*, 204*b*, 204*c* to 204*x*. In the exemplary illustration, four Fasteners 204*a*, 204*b*, 204*c* to 204*x* are illustrated; however, more or fewer Fasteners 204*a*, 204*b*, 204*c* to 204*x* may be utilized as is desired for functionality, aesthetics and to accommodate varying lengths of the Collar Body 202. The Fasteners 204*a*, 204*b*, 204*c* to 204*x* may couple the Detachable Collar 130 to the Garment 120 at the collar of the Garment 120. The Fasteners 204*a*, 204*b*, 204*c* to 204*x* may, in some embodiments, include "pin and cap" style fasteners. Additionally, in some alternate embodiments, other fastener types may be utilized as desired for functionality. For example, hook style materials may be desired for some embodiments of the Fasteners 204*a*, 204*b*, 204*c* to 204*x*. Moreover, adhesives may be more useful for yet other embodiments of Fasteners 204*a*, 204*b*, 204*c* to 204*x*.

Lastly, a Left Pocket 206 and Right Pocket 208 may be seen on the sides of the Collar Body 202. The Left Pocket 206 and Right Pocket 208, are substantially triangular in shape, with two sides coupled to the Collar Body 202 and the third side remaining open as to enable the pockets to receive the tips of Garment's 120 collar. In this way the Detachable Collar 130 may be easily utilized on Garments 120 that already have permanent collars, thereby expanding the kind of garment types the Detachable Collar 130 is capable of being used with. The Left Pocket 206 and Right Pocket 208 also aid the comfort of the Wearer 110. The depth and sizing of the Left Pocket 206 and Right Pocket 208 may vary dependent upon the collar size of the Garment 120.

Figure 3:
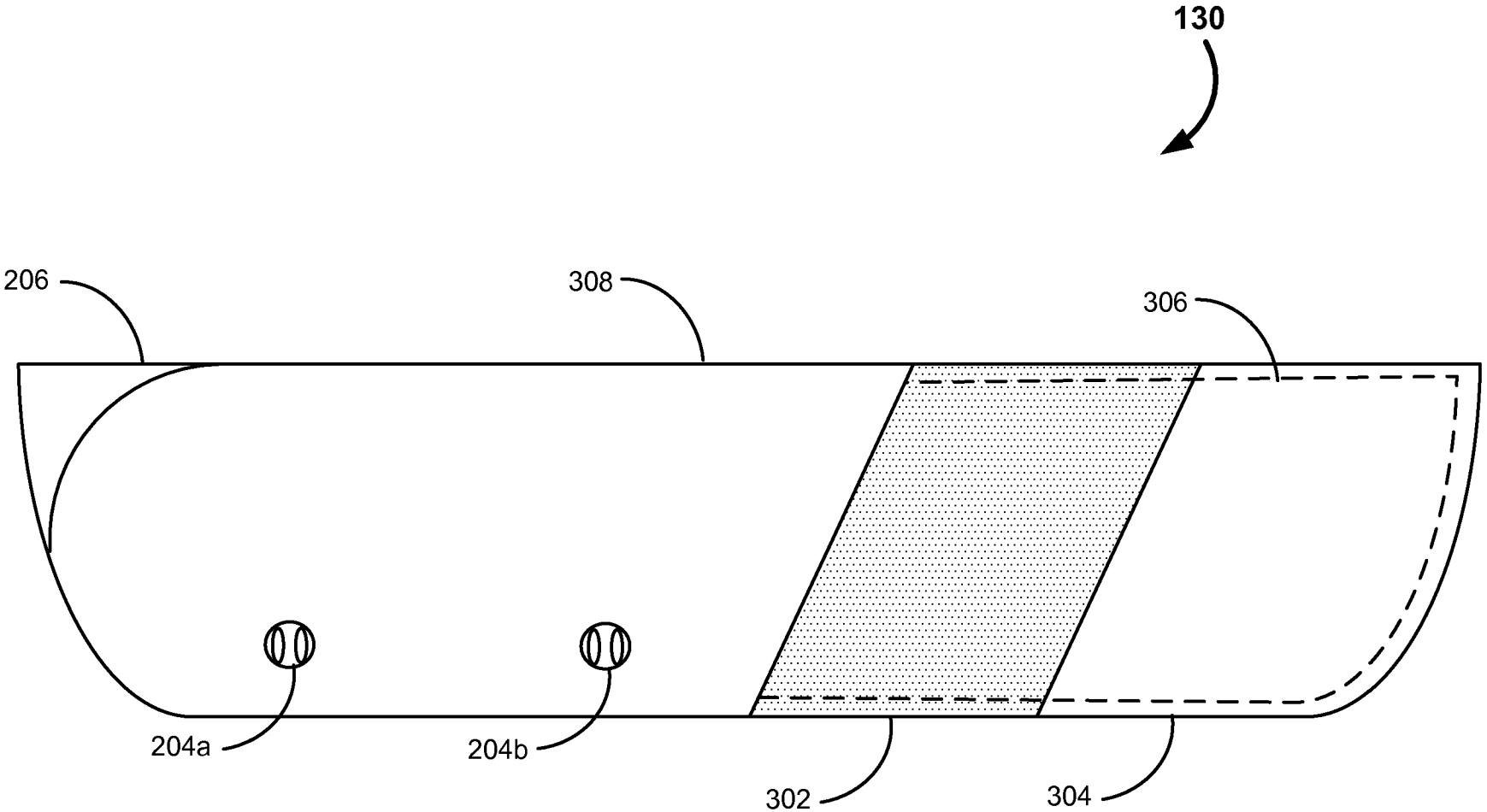
FIG. 3 shows a cut-away illustration of a detachable collar in accordance with an embodiment of the present invention.

FIG. 3 shows a cut-away illustration of the Detachable Collar 130. Again the Left Pocket 206 and some of the Fasteners 204*a*, 204*b*, 204*c* to 204*x* may be seen. In some embodiments, as is illustrated in this exemplary figure, the Detachable Collar 130 may include three distinct layers: the Interfacing Layer 302, Front Side Layer 304 and Back Side Layer 308. Of course, more or fewer layers may be utilized. For example a thermal layer may be included for low temperature variants of the Detachable Collar 130. Alternatively, the Interfacing Layer 302 may be omitted in the situation that a less stiff Detachable Collar 130 is desired.

The Interfacing Layer 302 is intended to provide the Detachable Collar 130 with additional stiffness and rigidity. This may be of particular importance for "standup" style collars. In some embodiments, the interfacing may include fusible or non-fusible interfacing. Additionally, boning, wire or additional fabric layers may replace the Interfacing Layer 302 to enhance rigidity in some embodiments. Moreover, in some embodiments, only portions of the Detachable Collar 130 include interfacing. For example, it may be desirable to have interfacing along the Fasteners 204*a*, 204*b*, 204*c* to 204*x* but not along the remaining portions of the collar.

The Back Side Layer 308 may come in contact with the fabric of the Garment 120, and in some embodiments, the skin of the Wearer 110. As such, a soft, comfortable, and non-staining material may be used for the Back Side Layer 308. Additionally, allergy, moisture susceptibility, the ability to breathe, the ability to be easily cleaned, and aesthetics of the material for the Back Side Layer 308 may be considered. Examples of such materials of the Back Side Layer 308 may include natural and synthetic fabrics, plastic, rubber, leather or any other suitable material.

The Front Side Layer 304 may also come in contact with the fabric of the Garment 120, and in some embodiments, the skin of the Wearer 110. As such, a soft, comfortable, and non-staining material may be used for the Front Side Layer 304. Additionally, allergy, moisture susceptibility, the ability to breathe, the ability to be easily cleaned, and aesthetics of the material for the Front Side Layer 304 may be considered. Examples of such materials of the Front Side Layer 304 may include natural and synthetic fabrics, plastic, rubber, leather or any other suitable material. In some embodiments, the aesthetic properties of the Front Side Layer 304 may dominate the other considerations since the Front Side Layer 304 may be more readily visible once the Detachable Collar 130 is coupled to the Garment 120.

Stitching 306 is shown holding the Back Side Layer 308, Interfacing Layer 302 and Front Side Layer 304 together. The Stitching 306 may, in some embodiments, be hidden from exterior viewing of the Detachable Collar 130. Although Stitching 306 is illustrated in the exemplary figure, other methods of joining the Back Side Layer 308, Interfacing Layer 302 and Front Side Layer 304 together may be utilized. For example, glues, lamination techniques, rivets or any other suitable method may be utilized for annealing the Back Side Layer 308, Interfacing Layer 302 and Front Side Layer 304.

Figure 4:
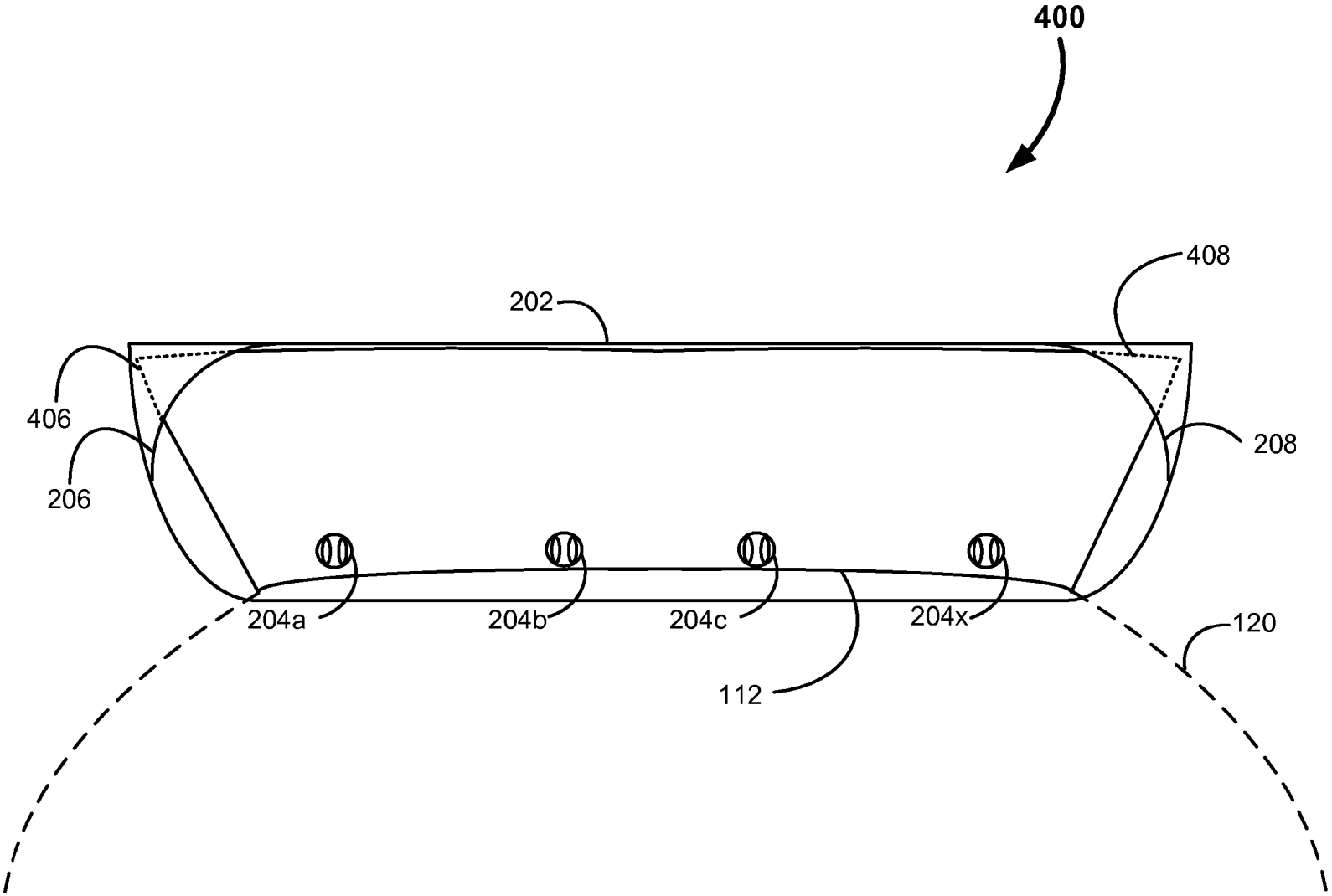
FIG. 4 shows a detailed illustration of a detachable collar coupled to a garment in accordance with an embodiment of the present invention.

FIG. 4 shows a detailed illustration of the Detachable Collar 130 coupled to the Garment 120, shown generally at 400. In this exemplary illustration, the Permanent Collar 112 of the Garment 120 may be seen engaging the Detachable Collar 130. The Fasteners 204*a*, 204*b*, 204*c* to 204*x* couple to the Permanent Collar 112. In some embodiments, the pin portion of the Fastener 204*a*, 204*b*, 204*c* to 204*x* may pass through the Permanent Collar 112. The cap portion of the Fastener 204*a*, 204*b*, 204*c* to 204*x* may then cover the pin and securely fasten the Detachable Collar 130 to the Permanent Collar 112. The Left Collar Tip 406 and Right Collar Tip 408 may slip into the pockets created by the Left Collar Tip 406 and Right Collar Tip 408, respectively. This ensures that the Permanent Collar 112 remains closely positioned to the Collar Body 202 and enhances Wearer 110 comfort and proper fit.

Figure 5A:
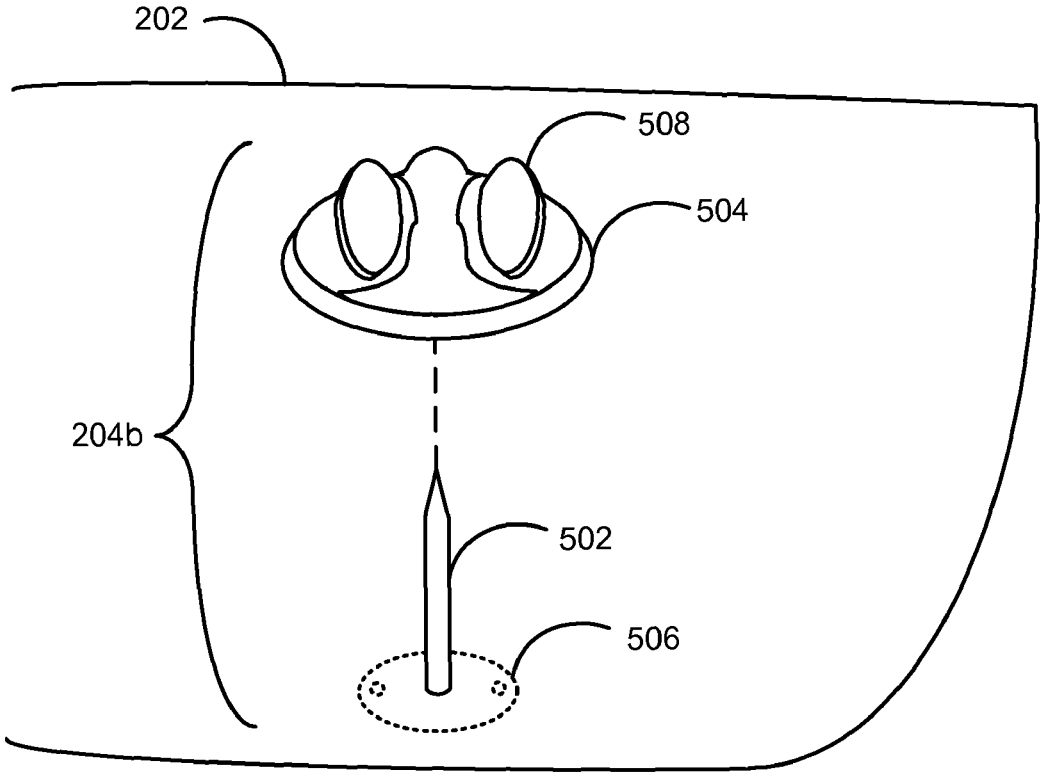
FIG. 5A shows a detailed illustration of a detachable collar fastener in accordance with an embodiment of the present invention.

FIG. 5A shows a detailed illustration of the exemplary Fastener 204*b*. The Fastener 204*b* includes a cap and pin portion. The pin portion may include a Pin Shaft 502 extending up from the Pin Base 506. The Pin Base 506 may be embedded within the Collar Body 202, thereby coupling the Fastener 204*b* to the Detachable Collar 130.

The cap covers the pin portion. The cap may include a Cap Top 504 and Cap Grips 508. The Cap Top 504 may engage the Pin Shaft 502. The Cap Top 504 protects the Wearer 110 from being injured by the Pin Shaft 502. The Pin Shaft 502 may pierce and pass through the Permanent Collar 112. The Cap Top 504 additionally acts to flank the Permanent Collar 112, thereby coupling the Detachable Collar 130 to the Garment 120.

The Cap Grips 508 may be spring mounted as to pinch the Pin Shaft 502 when engaging the Cap Top 504. The pinching of the Pin Shaft 502 by the Cap Grips 508 ensures the cap remains fastened to the pin. Thus by squeezing the Cap Grips 508, the Wearer 110 may engage and disengage the Fasteners 204*a*, 204*b*, 204*c* to 204*x* at will.

Figure 5B:
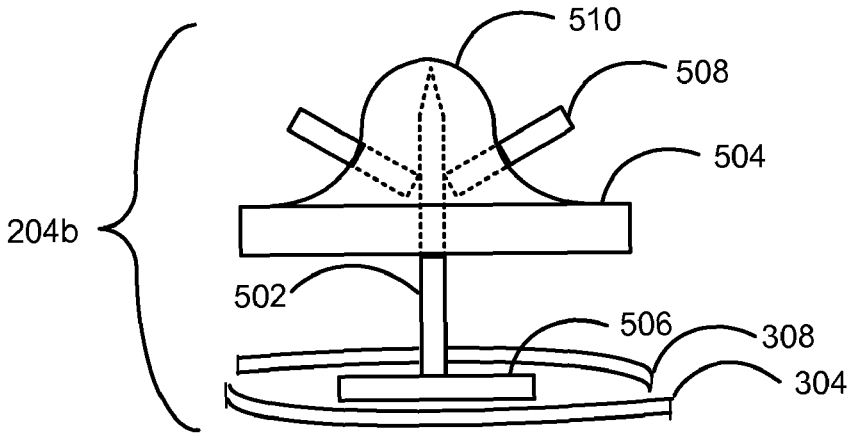
FIG. 5B shows a cut-away illustration of a detachable collar fastener in accordance with an embodiment of the present invention.

FIG. 5B shows a cut-away illustration of the Fastener 204*b*. Here the Pin Base 506 is seen embedded within the Collar Body 202. Back Side Layer 308 and Front Side Layer 304 surround the Pin Base 506. The Pin Shaft 502 extends up from the Pin Base 506 and through the Back Side Layer 308. The Cap Top 504 covers the Pin Shaft 502. The top of the Cap Top 504 includes a Cap Enclosure 510. The Cap Enclosure 510 ensures the Pin Shaft 502 does not injure the Wearer 110. Likewise, the Cap Enclosure 510 holds the Cap Grips 508. Here the Cap Grips 508 may be seen as pinching the Pin Shaft 502.

While this invention has been described in terms of several preferred embodiments, there are alterations, modifications, permutations, and substitute equivalents, which fall within the scope of this invention. For example, wherein the disclosed detachable collar has been illustrated for human clothing, such a system may be just as easily extended for pet clothing purposes.

It should also be noted that there are many alternative ways of implementing the methods and apparatuses of the present invention. It is therefore intended that the following appended claims be interpreted as including all such alterations, modifications, permutations, and substitute equivalents as fall within the true spirit and scope of the present invention.

What is claimed is:

1. A detachable collar, useful in association with a garment, wherein the garment includes a permanent collar, the detachable collar comprising:

a collar body having a front side and a back side, wherein the collar body is substantially trapezoidal in shape, wherein the substantially trapezoid shape includes a short side and a long side, wherein the short side and the long side are substantially in parallel, and wherein the substantially trapezoidal collar body is worn with the short side along a neckline, wherein the collar body includes a left pocket and a right pocket located on the back side of the collar body at the corners of the long side, wherein the left pocket is located at the leftmost point of the collar body and the right pocket is located at the rightmost point of the collar body, wherein the left pocket and the right pocket are substantially triangular in shape and wherein two sides of the substantially triangular shaped left pocket and the right pocket are coupled to the collar body and further wherein the left pocket and the right pocket are configured to engage the permanent collar by receiving points of the permanent collar; and at least one fastener coupled to the collar body, wherein the fastener is configured to engage the permanent collar.

2. The detachable collar of claim 1, wherein the fastener includes a pin and a cap.

3. The detachable collar of claim 2, wherein the pin is configured to pierce the permanent collar, and wherein the cap is configured to engage the pin.

4. The detachable collar of claim 2, wherein the fastener further includes a hook and loop fastener.

5. The detachable collar of claim 1, wherein the fastener includes at least one magnet.

6. The detachable collar of claim 1, wherein the fastener includes a hook and loop fastener.

7. The detachable collar of claim 1, wherein the fastener includes at least one safety pin.

8. The detachable collar of claim 1, wherein the at least one fastener is located at a base of the collar body.

9. The detachable collar of claim 1, wherein the at least one fastener is located on the back side of the collar body.

10. The detachable collar of claim 1, wherein the collar body includes an interfacing layer located between the front side and the back side of the collar body.

11. The detachable collar of claim 10, wherein the interfacing layer includes fusible interfacing.

12. The detachable collar of claim 10, wherein the interfacing layer includes non-fusible interfacing.

13. The detachable collar of claim 10, wherein the interfacing layer extends through part of the collar body.

14. The detachable collar of claim 1, wherein the collar body has a substantially trapezoidal shape.

15. The detachable collar of claim 1, wherein the collar body has a variable length.

16. The detachable collar of claim 1, wherein the detachable collar is also configured to be attached to a collarless garment by engaging the at least one fastener along the neckline of the collarless garment.

* * * * *

UNITED STATES PATENT AND TRADEMARK OFFICE

CERTIFICATE OF CORRECTION

PATENT NO. : 7,770,236 B2
APPLICATION NO. : 12/018720
DATED : August 10, 2010
INVENTOR(S) : Lori Campana It is certified that error appears in the above-identified patent and that said Letters Patent is hereby corrected as shown below:

On the Title Page, under the heading Item (76) Inventor: delete "Gulisano" and insert --Campana--.

Signed and Sealed this

Fifth Day of October, 2010

David J. Kappos

David J. Kappos
*Director of the United States Patent and Trademark Office*